United States Patent [19]

Kawanishi et al.

[11] Patent Number: 4,939,062

[45] Date of Patent: Jul. 3, 1990

[54] NON-IMPACT ELECTRIC IMAGE TRANSFER RECORDING METHOD

[75] Inventors: Toshiyuki Kawanishi; Masato Igarashi, both of Numazu, Japan

[73] Assignee: Ricoh Company, Ltd., Tokyo, Japan

[21] Appl. No.: 257,881

[22] Filed: Oct. 14, 1988

[30] Foreign Application Priority Data

| | | | |
|---|---|---|---|
| Oct. 14, 1987 | [JP] | Japan | 62-258609 |
| Feb. 19, 1988 | [JP] | Japan | 63-037233 |
| Aug. 5, 1988 | [JP] | Japan | 63-195687 |

[51] Int. Cl.[5] ..... G03G 13/10

[52] U.S. Cl. ..... 430/117; 355/259

[58] Field of Search ..... 430/115, 112, 137, 117; 106/22, 20; 355/259

[56] References Cited

U.S. PATENT DOCUMENTS

| | | | |
|---|---|---|---|
| 4,762,764 | 8/1988 | Ng et al. | 430/137 |
| 4,838,940 | 6/1989 | Kan et al. | 406/20 |

*Primary Examiner*—John L. Goodrow

*Attorney, Agent, or Firm*—Oblon, Spivak, McClelland, Maier & Neustadt

[57] ABSTRACT

A non-impact electric image transfer recording method is disclosed, which comprises the steps of applying a recording voltage-signal to a recording medium comprising an electroconductive support and a polymer gel layer containing therein a liquid ink formed on the electroconductive support, thereby causing the liquid ink to ooze from said polymer gel layer, and transferring the liquid ink to a recording sheet to form images thereon, which step may be followed by the step of applying to the polymer gel layer a voltage with an opposite polarity to that of the recording voltage-signal after the transfer of the liquid ink to a recording sheet.

5 Claims, 2 Drawing Sheets

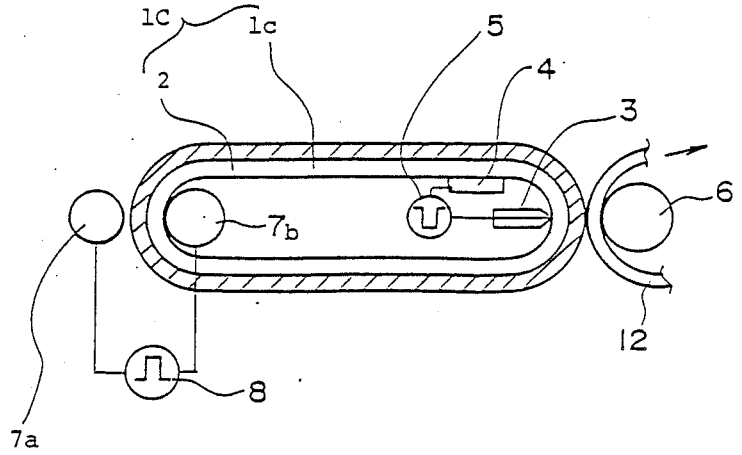
Fig. 4
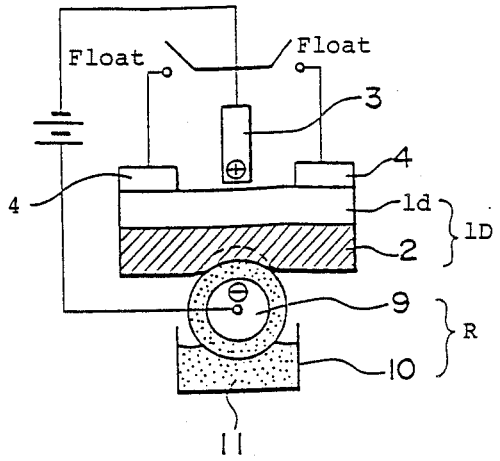
Fig. 5
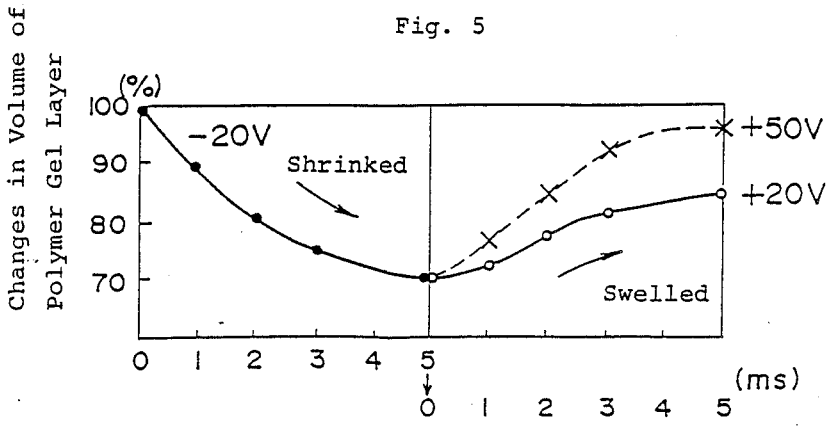

NON-IMPACT ELECTRIC IMAGE TRANSFER RECORDING METHOD

BACKGROUND OF THE INVENTION

The present invention relates to a non-impact electric image transfer recording method, and more particularly to a non-impact electric image transfer recording method by making use of a shrinkage and expansion phenomenon of a polymer gel when voltage is applied thereto, which image transfer recording method is capable of yielding clear images on a transfer sheet with clear background even if image transfer is made in repetition to a number of transfer sheets.

In accordance with the remarkable development of computers and facsimile apparatus, printers which serve as the terminal apparatus therefor are unquestionably important apparatus in such fields. Such printers can be roughly classified into two categories, an impact-type printer (i.e., a mechanical printer) and a non-impact-type printer. As to the recording systems for use with the non-impact-type printer, the following five systems are known: (1) electro-photographic system, (2) thermosensitive coloring system, (3) electric discharge system, (4) thermosensitive image transfer system, and (5) non-impact electric or electro-thermic image transfer system. The former impact-type printer has the inevitable shortcoming that it generates noise during operation because of its mechanical structure.

In contrast to this, the latter non-impact type printer has the advantage that it does not generate noise during operation, but has several problems in each recording system as well. Among these recording systems, the above-mentioned (5) electric image transfer system (electric image transfer recording system) has the advantages that images can be obtained with high resolution directly on a sheet of plain paper with high recording speed, and the apparatus for this system can be made compact in size.

Further, a method of electrothermally heating an ink-continuing porous thermal head imagewise, thereby transferring the ink imagewise to a transfer sheet has been reported, for instance, in Summary of Lectures of National Convention No. 1295, the Institute of Electronics and Communication Engineers, 1985. This method has many excellent advantages, but also has the shortcoming that clear images cannot be obtained when transferred to a number of transfer sheets because of the occurrence of the fogging in the background, and image tailing.

Furthermore, in Japanese Laid-Open patent application 62-124980, there is proposed another method of electrothermally transferring images to a transfer sheet comprising the two steps of (i) softening a thermally transferable ink contained in an ink roller which comprises a porous material impregnated with the ink by application of heat or a voltage to the ink roller and (ii) transferring the softened ink to a sheet of paper with application of pressure.

This method, however, has the shortcoming that it is difficult in principle to keep the ink softened during the two steps, so that printed images are apt to become uneven in image density and some portions of the images are unprinted.

Furthermore, in Japanese Laid-Open patent application 62-5889, there is proposed a thermal image transfer recording method by making use of the shrinkage of a polymer gel, in which an aqueous-ink-containing polymer gel is shrunk by heating the same with a thermal head, so that the aqueous ink is caused to ooze imagewise onto a printing sheet. In this recording method, the polymer gel can be used in repetition by replenishing the aqueous ink to the gel and reswelling the same from time to time. This method, however, has the shortcoming that the thermal response of the polymer gel is considerably slow, for example, as long as more than 5 ms for a 1 μm thick polymer gel layer.

Moreover, in Japanese Laid-Open patent application 60-60690, there is shown a recording method in which an ink-containing-polymer gel is shrunk under the conditions where the phase transition of the polymer gel takes place, with the voltage application thereto as being one of such conditions. In this patent application, it is merely described that the ink can be replenished by dipping the polymer gel into the ink. However, this method has in fact the shortcoming that it takes several hours for the polymer gel to get back to its original state just by dipping the polymer gel into the ink.

SUMMARY OF THE INVENTION

It is therefore an object of the present invention to provide a non-impact electric image transfer recording method capable of yielding clear images with uniform density, free from print missing portions, even when image transfer was repeated a number of times, which method also has the features that the recording response is quick and ink replenishment speed is great.

The above object of the present invention can be attained by a non-impact electric image transfer recording method using a recording medium comprising an electro-conductive support and a polymer gel layer formed thereon, comprising the steps of causing a liquid ink contained in the polymer gel layer to ooze therefrom by applying recording signals to the polymer gel layer through a recording electrode, and transferring the liquid ink imagewise to a recording sheet.

The above object of the present invention can also be more effectively attained by applying to the polymer gel layer a voltage with an opposite polarity to that of the voltage applied at the time of recording after the above-mentioned recording steps.

Furthermore, the above object of the present invention can also be more effectively attained by providing a liquid ink replenishment apparatus and applying to the polymer gel layer through the liquid ink replenishment apparatus a voltage with an opposite polarity to that of the voltage applied at the time of recording, thereby performing the replenishment of the liquid ink more efficiently.

BRIEF DESCRIPTION OF THE DRAWINGS

In the drawings,

FIGS. 2, 3 and 4 are schematic illustrations of the apparatus for performing the non-impact electric image transfer recording method according to the present invention.

FIG. 5 is a graph showing the changes in the volume of the polymer gel layer when a voltage is applied thereto.

DETAILED DESCRIPTION OF THE PREFERRED EMBODIMENTS

Figure 1:
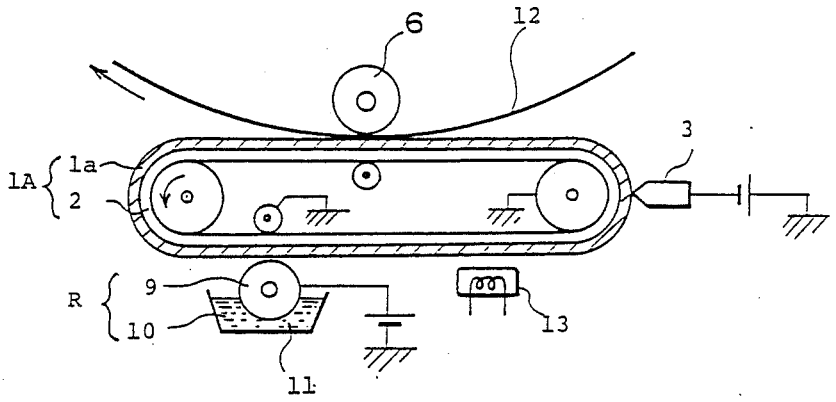
FIG. 1 is a schematic illustration in explanation of a non-impact electric image transfer recording method according to the present invention.

When a recording voltage signal is applied to a polymer gel layer including a liquid ink, formed on an electroconductive support by a recording electrode, the portion of the polymer gel layer to which the recording voltage signal is applied is quickly shrunk, so that the liquid ink contained in that portion is caused to ooze and imagewise transferred to a recording sheet. In the non-impact electric image transfer method according to the present invention, the above phenomenon is utilized, whereby clear copy images, which are uniform in printed image density and free from printing missing portions, are obtained even when image transfer is repeated a number of times.

The polymer gel for use in the present invention consists essentially of a cross-linked polymer of a three dimensional network type obtained by polymerizing a monomer in the presence of a cross linking agent and a solvent, and has such a structure that the solvent is held within the three dimensional network type polymer.

Examples of such a monomer for use in the present are as follows: acrylic acid; methacrylic acid; acrylic esters and methacrylic esters such as methyl acrylate, methyl methacrylate, butyl acrylate, cyclohexyl acrylate, dimethylaminoethyl methacrylate, benzyl acrylate, carbitol acrylate, 2-ethylhexyl acrylate, 2-hydroxyethyl acrylate, 2-hydroxyethyl methacrylate, 2-hydroxypropyl acrylate, 2-hydroxypropyl methacrylate and glycidyl methacrylate; amides of acrylic acid and methacrylic acid such as acrylamide, N-methylolacrylic and N-diacetoneacrylamide; nitriles of acrylic acid and methacrylic acid such as acrylonitrile and methacrylonitrile; nitrogen-containing heterocyclic compounds such as N-vinylpyrrolidone, 2-vinylpyridine, 3-vinylpyridine, 4-vinylpyridine, 2-vinylimidazole, N-methyl-2-vinylimidazole and N-vinylimidazole.

Examples of the cross linking agent for use in the present invention are the following poly-functional monomers and oligomers:

N,N'-methylenebisacrylamide,
diallyl isophthalate,
diallyl maleate,
diallyl chlorendate,
diallyl adipate,
diallyl diglycolate,
triallyl cyanurate,
diethyleneglycolbisallyl carbonate,
ethylene glycol diacrylate,
diethylene glycol diacrylate,
triethylene glycol diacrylate,
polyethylene glycol diacrylate,
polyethylene glycol dimethacrylate,
polypropylene glycol diacrylate,
polypropylene glycol dimethacrylate,
butylene glycol diacrylate,
butylene glycol dimethacrylate,
neopentyl glycol diacrylate,
neopentyl glycol dimethacrylate,
1,4-butanediol diacrylate,
1,6-hexanediol diacrylate,
1,6-hexanediol dimethacrylate,
pentaerythritol diacrylate,
pentaerythritol triacrylate,
trimethylolpropane triacrylate, and
trimethylolpropane trimethacrylate.

Preferable polymerization initiators and sensitizers for use in the present invention include: ammonium peroxide; carbonyl compounds such as benzoin, polynuclear quinone compounds and benzoyl peroxide; azo compounds such as azobisisobutyronitrile and diazodium compounds; organic sulfur compounds such as mercaptans and alkyl disulfides; oxidation-reduction systems such as iron (II)—hydrogen peroxide; halogen compounds such as silver halogenide, mercury bromide and carbon tetrachloride; photosensitive dyestuffs such as Eosine—amine, riboflavin and cyanine dyes; organometallic compounds such as alkyl metals; and metal carbonyl compounds such as manganese carbonyl.

In the polymer gel for use in the present invention, it is preferable that the concentration ratio of the cross linking agent to the monomer be in the range of $10^{-3}$ to 1, and the concentration of the monomer be in the range of $10^{-3}$ to 10 moles/litre. It is preferable that the concentration of a polymerization initiator or sensitizer, which is employed when necessary, be in the range of $10^{-6}$ to $10^{-2}$ moles/litre.

A polymer gel can be prepared as follows: First a polymerizing solution is prepared, and an appropriate amount of the solvent of the polymerizing solution is eliminated by evaporation, and then polymerization is initiated.

The above polymerization is carried out, for example, by a conventional photopolymerization method. More specifically, after the polymerization, unreacted monomer, polymerization initiator and other components for the polymerization are removed from the reaction mixture by washing, so that a polymer with a three-dimensional network structure is obtained.

When preparing the organic polymer gel from the aforementioned cross-linked polymers, conventionally known organic solvents, water and mixtures of the organic solvents and water can be used as solvent.

Preferable examples of such solvents are water; alcohols such as methanol and ethanol; ketones such as acetone and methyl ethyl ketone; hydrocarbons such as pentane, cyclohexane and benzene; hydrocarbon halogenide such as tetrachloroethane and dichlorobenzene; esters such as ethyl formate, ethyl acetate and isoamyl acetate; ethers such as dioxane and diglyme; amides such as dimethylformamide and dimethyl-acetamide; sulfur-containing solvent such as dimethyl sulfoxide; mixtures of solvents thereof; and solutions prepared by adding solutes such as lithium perchlorate, ammonium proprionate, urea and glycose to the above-mentioned solvents.

Conventionally employed pigments and dyes can be in the liquid ink unless they have adverse effects on the present invention.

When pigments are employed in the liquid ink for use in the present invention, it is preferable that such pigments be finely-divided with a particle size of a submicron order, or with a smaller particle size.

As the dyes for use in the present invention water-soluble dyes suitable for use with the above-mentioned water-soluble polymer gels are used.

Preferred water-soluble dyes include basic dyes such as methylene blue, malachite green and fuchsine; acid dyes such as rhodamine B, Rose Bengale, Tartrazine and Phthalocyanine Blue; and direct dyes such as Direct Black D and Direct Black 154.

The thus prepared liquid ink can be contained in the polymer gel either at the time of the preparation of the polymer gel preparing it or after the preparation of the same, or even after the formation of the polymer gel layer on a support. In particular, when the ink is contained after the formation of the polymer gel layer, it is preferable that the polymer gel be impregnated with the ink solution or with an ink dispersing liquid because the ink is absorbed in the polymer gel within a short time as the polymer gel is cooled.

It is preferable that the amount of such an ink be about 1 to 20 parts by weight to 100 parts by weight of the polymer gel and that a polymer gel layer have a thickness of about 1 to 100 μm for obtaining high printed image density, high repetitive usability and high thermal response for use in practice. More specifically, when the concentration of the ink is too low, the obtained printed density becomes too low and the number of the repeated use decreases. Further, when the polymer gel layer is too thin, high printed image density and high repetitive usability cannot be obtained, while when the polymer gel layer is too thick, the thermal response of the polymer gel layer decreases.

The polymer gels for use in the present invention are ionic polymer gels.

Preferable examples of an anionic polymer gel for use in the present invention are carboxyl-group-containing homopolymers and copolymers, such as homopolymers and copolymers of acrylic acid, and methacrylic acid, copolymers of maleic acid such as acrylamide—acrylic acid copolymer, starch—methacrylic acid copolymer, PVA—acrylic acid copolymer, and isobutylene—maleic acid copolymer; and sulfonic acid group containing homopolymers and copolymers such as homopolymers and copolymers of 2-acrylamide-2-methylpropane sulfonic acid.

Preferable examples of a cationic polymer gel for use in the present invention are piperidion group-, amino group- and dimethylamino group-containing polymers such as polymers prepared from vinylpyridine, aminovinylpyridine, dimethylamino-vinylpyridine, trimethyl(N-acryloyl-3-aminopropyl ammonium salts) and N-acryloylpiperidine.

A phase transition phenomenon takes place in such a polymer gel layer under certain conditions when the conditions such as temperature, solvent composition, pH, ionic strength, electric field are changed. At such a phase transition point, the solvent is rapidly discharged from the three-dimensional network type polymer gel, so that rapid shrinkage of the polymer gel and rapid absorption of the solvent by the polymer gel take place. In other words, the reversible swelling of the polymer gel takes place.

When a liquid ink is contained in a solvent by which the polymer gel is swelled, or in a solvent which is held by the polymer gel, and a voltage signal is applied to the polymer gel in such a manner that the polymer gel is shrunk in a desired image pattern by utilizing the above-mentioned property, only the signal-applied portions are imagewise shrunk and imagewise discharge the ink. When the thus discharged ink is transferred to a transfer sheet, images corresponding to the applied voltage signal are formed on the transfer sheet.

As an electroconductive support for supporting the polymer gel layer containing the above-mentioned liquid ink, the following examples are available for use in the present invention: a metal drum and a sheet made of, for instance, aluminum, brass, stainless steel, and nickel; a metal-deposited sheet, prepared by depositing a metal such as aluminum and nickel on a sheet of polyethylene terephthalate, polypropylene, nylon and paper; an electroconductive plastic sheet and paper treated so as to be electroconductive by applying to a plastic sheet or paper an electroconductive material such as titanium oxide, tin oxide and carbon black, together with an appropriate binder agent. Such electroconductive supports can be made in any shape, such as in the shape of tape, sheet, belt or drum, but among those shapes, belt shape is preferable for use in practice.

As mentioned previously, in the non-impact electric image transfer recording method of the present invention, voltage recording signals are applied by a recording electrode to the above-described recording medium having a liquid-ink-containing polymer gel layer, so that the liquid ink is caused to ooze from the polymer gel layer in such a manner as to correspond to the applied voltage recording signals, thereby recording images by the ink on a recording sheet.

In the present invention, a voltage opposite in polarity to the voltage applied when recording may be applied to the polymer gel after the above-mentioned recording step for more effective recording. For the application of such an opposite polarity voltage to the polymer gel, a roller for uniform ink application and an electroconductive roller for ink replenishment may be employed as illustrated in FIGS. 1 to 3.

With reference to the accompanying drawings, the non-impact electric image transfer recording method according to the present invention will now be explained in more detail.

Figure 2:
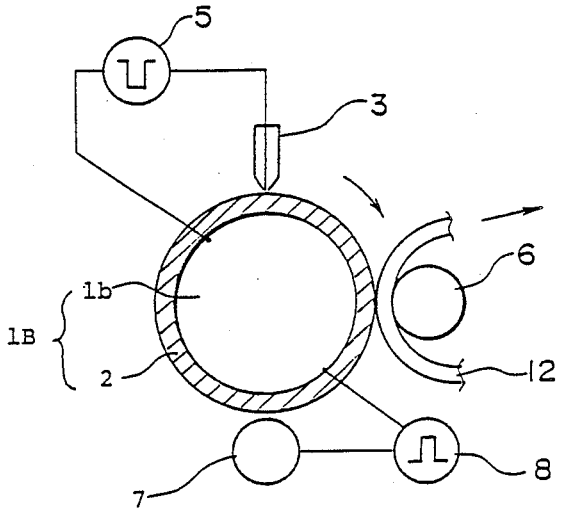

FIG. 1 shows an example of the non-impact electric image transfer recording method using a recording medium comprising as an electroconductive support an electro-conductive belt. More specifically, a recording medium 1A comprises an electroconductive belt la and a liquid ink containing polymer gel layer 2 formed thereon. A recording voltage signal is applied to the recording medium lA by a recording electrode 3. Upon application of the recording signal, the portion of the polymer gel layer 2 is quickly shrunk, so that the liquid ink contained in the voltage-applied portion is caused to ooze therefrom. The oozed liquid ink stays on the polymer gel layer 2 for a few minutes and is then transferred to a recording sheet 12 by use of, for instance, a pressure application roller 6. This image transfer step is repeated, whereby 10 to 20 copies are made.

In this example, the liquid ink is subsequently supplied to the portion of the polymer gel layer 2 to which the recording signal is applied (hereinafter referred to as the recording portion) from the portion of the polymer gel layer 2 to which no recording signal is applied (hereinafter referred to as the non-recording portion) by the surface tension of the liquid ink contained in the non-recording portion, whereby the liquid-ink-containing state is maintained in the recording portion of the polymer gel layer 2. However, when such image transfer is repeated a number of times, there is the risk that the obtained image density gradually decreases in the course of repeated image transfer. Therefore, it is preferable that the liquid ink be replenished to the polymer gel layer 2 from a liquid ink replenishment apparatus R, and subsequently the surface of the polymer gel layer 2 be dried by a surface-drying heater 13.

The liquid ink replenishment apparatus R comprises a liquid ink tank 10 for holding a liquid ink 11, and an electroconductive roller 9 for liquid ink replenishment. The liquid ink 11 can be replenished by the application of a voltage with an opposite polarity to that of the voltage applied during recording to the electroconductive roller 9. When a voltage of −5 to −100 volts is applied to the polymer gel layer 2 for recording, it will be necessary to apply a voltage of +10 to +200 volts for the replenishment of the liquid ink to the polymer gel layer 2 by the electro-conductive roller 9.

FIG. 2 shows another example of the non-impact electric image transfer recording method using a recording medium which comprises as an electroconductive support an electroconductive conductive drum lb. More specifically, a recording medium lB comprises an electroconductive drum 1*b* and a liquid-ink-containing polymer gel layer 2 formed thereon. When a recording voltage signal 5 is applied to the polymer gel layer 2 by a recording electrode 3, the voltage-signal-applied portion of the polymer gel layer 12 is quickly shrunk, so that the liquid ink contained in the voltage-signal-applied portion is caused to ooze therefrom. The oozed liquid ink stays on the polymer gel layer 2 for a few minutes and is then transferred to a recording sheet 12 by use of a pressure application roller 6. This image transfer step is repeated, whereby 10 to 20 copies can be made.

In this example, the liquid ink is subsequently supplied to the voltage-signal-applied portion of the polymer gel layer 2 from the non-recording portion by the surface tension of the liquid ink contained in the non-recording portion, whereby the liquid ink containing state is maintained in the voltage-signal-applied portion of the polymer gel layer 2. However, when such image transfer is repeated a number of times, there is the risk that the obtained image density becomes uneven in the course of repeated image transfer. In this example, a voltage with a polarity opposite to that of the voltage applied during recording is applied to the polymer gel layer 12 through an ink layer uniforming roller 7 in accordance with an ink layer uniforming signal 8 applied thereto, so that the content of the liquid ink in the polymer gel layer 2 is always kept constant.

FIG. 3 shows a further example of the non-impact electric image transfer recording method using a recording medium which comprises as an electroconductive support an electroconductive belt and a liquid-ink-containing polymer layer formed thereon. More specifically, a recording medium lC comprises an electroconductive support 1*c* and a liquid ink containing polymer gel layer 2. When a recording voltage-signal 5 is applied to the recording medium lC by a recording electrode 3, the voltage-signal-applied portion of the polymer gel layer 2 is rapidly shrunk, so that the liquid ink contained in the voltage-signal-applied portion is caused to ooze therefrom in the same manner as in the recording method shown in FIG. 2. The oozed liquid ink is transferred to a recording sheet 12 by use of a pressure application roller 6.

In this example, a voltage with a polarity opposite to that of the voltage applied during recording is applied to the polymer gel layer 2 through a pair of ink layer uniforming rollers 7*a* and 7*b* in accordance with an ink layer uniforming signal 8 applied thereto, so that the content of the liquid ink in the polymer gel layer 2 is always kept constant. In FIG. 3, reference numeral 4 indicates a return electrode serving as a counterpart electrode for the recording electrode 3.

FIG. 4 shows still another example of the non-impact electric image transfer recording method, in which substantially the same recording medium lD as those explained so far is employed, which comprises an electroconductive support ld and a liquid-ink-containing polymer gel layer 2 formed thereon.

When a recording voltage-signal is applied to the recording medium lD by a recording electrode 3, the voltage-signal-applied portion of the polymer gel layer 2 is rapidly shrunk, so that the liquid ink contained in the voltage-signal-applied portion is caused to ooze therefrom in the same manner as in the recording method shown in FIG. 2. In FIG. 4, reference numeral 4 indicates a return electrode.

In this example, a voltage with a polarity opposite to that of the voltage applied during recording is applied to the polymer gel layer 2 through an electroconductive roller 9 for ink replenishment, which is disposed in a liquid ink replenishment tank 10, so that the liquid ink 11 is replenished to the polymer gel layer 2. Thus the content of the liquid ink in the polymer gel layer 2 is always kept constant.

In the present invention, the voltage of the recording signal applied to the polymer gel layer 2 at the time of recording varies, depending upon the thickness of the polymer gel layer 2, but the applied voltage is normally in the range of −10 to −50 V when the employed polymer gel is an anionic gel. In the example shown in FIG. 3, the applied voltage is in the range of +10 to +50 V. In the case where a voltage with a polarity opposite to that of the voltage applied during recording is applied to the polymer gel layer 2, the applied voltage is normally in the range of +20 to +100 V. In the example shown in FIG. 4, the voltage applied to the polymer gel layer 2 after recording is in the range of −20 to −100 V.

Example 1

A non-impact electric image transfer recording medium was prepared by coating a 20 μm thick Ni electroconductive belt with a polymer gel liquid consisting of 1 wt.% of Acid Red 254, 90 wt.% of water, 6 wt.% of polyvinyl alcohol and 3 wt.% of methacrylic acid, with a thickness of 10 μm.

By use of the thus prepared non-impact electric image transfer recording medium in the non-impact recording apparatus as shown in FIG. 1, image transfer was performed.

A recording signal with a voltage of +20 V and a pulse width of 0.5 ms was applied to the recording medium. When a liquid ink was replenished from a liquid-ink-replenishment apparatus R, a voltage of −20 V with a pulse width of 1 ms was applied to the polymer gel layer la through the electroconductive roller 9 for liquid ink replenishment. Subsequently, the surface of the polymer gel layer 1*a* was dried by the surface-drying heater 13.

As a result, clear images with uniform image density, free from printing missing portions, were obtained even when such image transfer was performed to 2,000 transfer sheets.

Example 2

A non-impact electric image transfer recording medium was prepared by coating a 30 μm thick stainless steel electroconductive belt with a polymer gel liquid consisting of 1 wt.% of sulfonated phthalocyanine blue, 79 wt.% of water, 10 wt.% of 2-acrylamide-2-methylpropanesulfonic acid, and 10 wt.% of hydroxyethyl methacrylate with a thickness of 5 μm.

By use of the thus prepared non-impact electric image transfer recording medium in the non-impact recording apparatus as shown in FIG. 1, image transfer was performed.

A recording signal with a voltage of +10 V and a pulse width of 0.5 ms was applied to the recording medium. When a liquid ink was replenished from a liquid-ink-replenishment apparatus R, a voltage of −30 V with a pulse width of 1 ms was applied to the polymer gel layer 1*a* through the electroconductive roller 9 for liquid ink replenishment.

As a result, clear images with uniform image density, free from printing missing portions, were obtained even when such image transfer was performed to 2,000 transfer sheets.

Example 3

Malachite green was dissolved in a mixture of water and a PVA-acrylic acid polymer gel with application of heat thereto, whereby a liquid-ink-containing polymer gel consisting of 80 wt.% of a liquid ink and 20 wt.% of a PVA-acrylic acid polymer gel was prepared.

The thus prepared liquid-ink-containing polymer gel was coated on an electroconductive aluminum drum to form a polymer gel layer with a thickness of 20 μm on the aluminum drum.

By use of the non-impact recording apparatus as shown in FIG. 3, a recording signal with a voltage of −20 V and a pulse width of 5 ms was applied to the polymer gel layer by a recording electrode having a diameter of 100 μm. Immediately the liquid ink was caused to ooze from the polymer gel layer, so that images were transferred to a recording sheet.

After the image transfer, the thickness of the polymer gel layer was decreased to 14 μm and the volume of the polymer gel layer was shrunk by 30%. After the recording of the images, an ink-uniforming signal with a voltage of +20 V and a pulse width of 5 ms was applied to the ink-uniforming roller. As a result, the thickness of the polymer gel layer was increased up to 17 μm. When a greater ink-uniforming signal with a voltage of +50 V and a pulse width of 5 ms was applied to the ink-uniforming roller, the thickness of the polymer gel layer was increased to 19 μm, which was almost the same thickness as the original thickness.

FIG. 5 is a diagram showing the above changes in the volume of the polymer gel layer.

Even when such image transfer was repeated a number of times, clear transferred images free from background smearing were equally obtained.

Example 4

The same ink-containing polymer gel layer as that used in Example 3 was formed with a thickness of 10 μm on a 10 μm thick electroconductive support consisting of 70 wt.% of an aromatic polyamide and 30 wt.% of electroconductive carbon, whereby a non-impact electric image transfer recording medium was prepared.

Image transfer was performed by use of a non-impact recording apparatus as shown in FIG. 3 with application of a recording signal with a voltage of −50 V and a pulse width of 2 ms across the recording electrode 3 and the return electrode 4, using the pressure application roller 6, whereby images were formed on a recording sheet.

After the recording, an ink-uniforming signal with a voltage of +50 V and a pulse width of 5 ms was applied across the ink-uniforming rollers 7*a* and 7*b*. The result was that the thickness of the polymer gel layer almost returned to the original thickness (10 μm).

Even when such image transfer was repeated a number of times, clear transferred images free from background smearing were equally obtained.

Examples 5 and 6, and Comparative Example

Non-impact electric image transfer recording media were prepared with the layer structures as indicated in Table 1 and were subjected to image transfer tests under the recording conditions and liquid ink replenishment conditions, by use of the non-impact recording apparatus as shown in FIG. 4, whereby transferred images were obtained on sheets of paper. The recording characteristics and ink replenishment characteristics are also shown in Table 1.

TABLE 1

| | | Example 5 | Example 6 | Comparative Example |
|---|---|---|---|---|
| Structure of Recording Medium | Electroconductive support | (8 μm)<br>Electroconductive carbon 35%<br>Aromatic polyamide 65% | (15 μm)<br>Electroconductive carbon 30%<br>Polycarbonate 70% | Same as Example 3 |
| | Polymer gel layer | | | |
| | Ink | Acid Red 254 1%<br>Water 90% | Sulfonated phthalocyanaine blue 1%<br>Water 79% | Same as Example 3 |
| | Polymer gel | (10 μm)<br>PVA 6%<br>Methacrylic acid 3% | (5 μm)<br>2-acrylamide-2-methol-propanesulfonic acid 10%<br>Hydroxyethyl methacrylate 10% | Same as Example 3 |
| Conditions Characteristics | Recording | +10V - 1 ms | +15V - 1 ms | +10V - 1 ms |
| | Replenishment | −20V - 2 ms | −30V - 2 ms | No voltage applied |
| | Recording | Clear magenta color images printed with repeated recording (n = 20 times). | Clear cyan color images printed with repeated recording (n = 20 times). | n = 1~2: Clear magenta images printed<br>n = 3 or more: Image density gradually decreased, and images became unsharp. |
| | Replenishment | Almost returned to the original state (n = 1). | Almost returned to the original state (n = 1). | The thickness of the polymer gel layer gradually decreased |

What is claimed is:

1. A non-impact electric image transfer recording method comprising the steps of:

applying a recording voltage-signal to a recording medium comprising an electroconductive support and a polymer gel layer containing therein a liquid ink formed on said electroconductive support, thereby causing said liquid ink to ooze from said polymer gel layer, and transferring said liquid ink to a recording sheet to form images thereon.

2. The non-impact image transfer recording method as claimed in claim 1, further comprising the step of applying to said polymer gel layer a voltage with an opposite polarity to that of said recording voltage-signal after the transfer of said liquid ink to a recording sheet.

3. The non-impact image transfer recording method as claimed in claim 2, wherein the step of applying to said polymer gel layer a voltage with an opposite polarity to that of said recording voltage-signal after the transfer of said liquid ink to a recording sheet is carried out by an electroconductive roller.

4. The non-impact electric image transfer recording method as claimed in claim 3, wherein said electroconductive roller is a roller for making the content of said liquid ink in said polymer gel layer uniform.

5. The non-impact electric image transfer recording method as claimed in claim 3, wherein said electroconductive roller is a roller for replenishing said liquid ink to said polymer gel layer.

* * * * *

UNITED STATES PATENT AND TRADEMARK OFFICE

CERTIFICATE OF CORRECTION

PATENT NO. : 4,939,062

DATED : July 3, 1990

INVENTOR(S) : KAWANISHI et al.

It is certified that error appears in the above-identified patent and that said Letters Patent is hereby corrected as shown below:

Column 3, Line 24, before "are as" insert --invention-- ;

line 33, "N-methylolacrylic" should read --N-methylolacrylamide-- .

Signed and Sealed this

Ninth Day of June, 1992

*Attest:*

*Attesting Officer*

DOUGLAS B. COMER

*Acting Commissioner of Patents and Trademarks*